US005486409A

United States Patent [19]

Curatolo et al.

[11] Patent Number: 5,486,409

[45] Date of Patent: Jan. 23, 1996

[54] NONWOVEN FABRICS FROM HIGH NITRILE COPOLYMERS

[75] Inventors: Benedict S. Curatolo, Valley View; George S. Li, Solon; Brandford E. Giddings, Shaker Heights, all of Ohio

[73] Assignee: The Standard Oil Company, Cleveland, Ohio

[21] Appl. No.: 324,290

[22] Filed: Oct. 17, 1994

Related U.S. Application Data

[63] Continuation of Ser. No. 79,183, Jun. 17, 1993, abandoned.

[51] Int. Cl.[6] ..... D04H 3/00

[52] U.S. Cl. ..... 428/221

[58] Field of Search ..... 428/221

[56] References Cited

U.S. PATENT DOCUMENTS

| | | | |
|---|---|---|---|
| 3,565,876 | 2/1971 | Ball et al. . | |
| 3,954,913 | 5/1976 | Uebele et al. . | |
| 3,984,499 | 10/1976 | Wardlow et al. . | |
| 4,062,857 | 12/1977 | Kobashi et al. . | |
| 5,106,925 | 4/1992 | Curatolo | 526/342 |

*Primary Examiner*—James C. Cannon

*Attorney, Agent, or Firm*—Teresan W. Gilbert; David J. Untener; Michael F. Esposito

[57] ABSTRACT

Disclosed are non-woven fabrics made from fibers formed from melt-processable and stable addition copolymers containing 30 to 90 weight percent acrylonitrile moiety and up to 70 weight percent methacrylonitrile moiety and optionally less than 20 weight percent moieties of other comonomers.

21 Claims, No Drawings

NONWOVEN FABRICS FROM HIGH NITRILE COPOLYMERS

This is a continuation of application Ser. No. 08/079,183, filed on Jun. 17, 1993, now abandoned.

This invention relates to nonwoven fabrics made from melt-spun fibers. The fibers are made from melt-processable copolymers of monomers that contain acrylonitrile and methacrylonitrile in amounts such that the copolymers contain the acrylonitrile moiety of at least 30 weight percent, usually at least 50 weight percent acrylonitrile. The fibers can contain the acrylonitrile moiety in amounts as high as 90 weight percent.

For the purposes of this invention a fiber and a filament are synonymous.

The fabrics of the present invention are made from fibers created by extruding a melt, as opposed to a solution, of the melt-processable copolymers through an orifice. This is usually accomplished in a spinarette, an assembly of multiple orifices, as will be-understood by those skilled in the art.

The copolymers used in the present invention are polymers of the addition polymerization of acrylonitrile (AN) and methacrylonitrile (MAN) and optionally other monomers having C=C double bonds that result in copolymers with the AN and MAN by addition polymerization.

The copolymers of the present invention are melt-processable because of the way they are made. Previously, polymers formed by the addition polymerization of over 20 weight percent AN with less than 80 weight percent MAN were unstable and subject to decomposition if worked as a melt. See Ball et al. U.S. Pat. No. 3,565,876 dated Feb. 23, 1971.

Briefly, one is enabled to make the melt-processable and stable polymer used in the present invention by copolymerizing the monomers in a polymerization zone to which are added the monomers, each at a substantially constant rate designed to form a copolymer of the desired composition, while keeping composition of the unreacted monomer mixture in said polymerization zone substantially constant. This is the key to avoiding long chains of the acrylonitrile moiety in the polymer molecule and consequently making the polymer that is melt-processable and stable at extrusion temperature and pressure conditions. This polymerization process in the polymerization zone can be effected in bulk, suspension, solution or emulsion polymerization systems, although suspension or emulsion polymerization are now preferred; a major reason for such preference is the superiority and economy of water as a heat transfer medium. In general we also now prefer emulsion polymerization to suspension because emulsion polymerization results in a faster polymerization rate using the monomers employed in making the melt-processable copolymers from which our fibers and fabrics are made.

A suitable way of producing such melt-processable copolymers by emulsion polymerization is to employ an indirectly water-cooled semi-batch reactor. Into the reactor is charged water containing the surfactant emulsifying agent. The vapor space of the reactor is then flushed with nitrogen gas and then a vacuum is pulled at elevated temperature to remove dissolved oxygen gas. This is done three or more times to essentially eliminate $O_2$ from the reactor. Then a small amount of the monomers, say 10% or less of the volume of monomers ultimately to be added are introduced, in ratios relative to each other such that during the addition polymerization reaction the weight percent composition of the unreacted monomers remains substantially constant. A suitable initiator such as 2,2'-azobis(2,4 dimethylvaleronitrile), is added to the resulting emulsion of monomer phase in the aqueous phase. Shortly thereafter the polymerization begins and a mixture of monomers of the same composition as the initial charge is fed into the emulsion at a substantially constant rate that is the same as the rate of reaction or slightly less than the rate of reaction. After the conversion is about 70–95 percent, the latex is pumped out of the reactor, coagulated in the usual manner, washed with water, or with water and methanol and stripped of monomers at suitable conditions of temperature and vacuum. This step also removes the water from the wet crumb.

During the polymerization process the relative ratios of the unreacted monomers in the reaction mixture are maintained such that the polymer produced has the substantially constant composition desired. This process prevents long chains of acrylonitrile building up. If such chains did build up the polymer would not be melt-processable and stable at the conditions of temperature and pressure necessary to extrude the polymer through the small orifices to make fibers or filaments.

In the foregoing polymerization a chain length modifier, such as n-dodecyl mercaptan is added right after the addition of the initiator. This helps regulate the molecular weight and makes the polymer somewhat easier to extrude.

After the polymerization has proceeded to the desired degree of monomer conversion, usually about 85 to 90 percent, a suitable shortstop such as diethyl hydroxylamine or 4-methoxylphenol can be added to terminate the polymerization.

In the present invention we are concerned with addition copolymers of acrylonitrile and methacrylonitrile wherein the amount of the acrylonitrile moiety in the polymer is from 30 weight percent to 90 weight percent. More usually the acrylonitrile moiety is in the range from 50 weight percent and up to 85 weight percent. It should be noted that the higher the acrylonitrile moiety, the more solvent resistant is the fiber, and the more ultraviolet light resistant. Further, when the degree of crystallization is high, the polymer fibers are more easily heat set. In general, a higher acrylonitrile moiety results in a higher degree of crystallization.

Prior art batch processes for the production of acrylonitrile/methacrylonitrile copolymers having at least 30 weight percent acrylonitrile moiety in the polymer produced copolymers which were not melt processable.

In the past, copolymers of AN and MAN were formed using only small amounts of AN, because polymers made with more than 20 percent by weight of polymerized acrylonitrile could not be extruded. For example, it is taught in U.S. Pat. No. 3,565,876 that up to about 20 percent by weight of acrylonitrile can be copolymerized with methacrylonitrile to form extrudible copolymers which can be readily oriented and possess excellent physical properties. Increasing the acrylonitrile content above 20 percent by weight in acrylonitrile/methacrylonitrile copolymers resulted in a resin which was unstable and not melt-processable by any of the usual commercial techniques known today, including extrusion.

In making fibers for the non-woven fabrics of this invention the specially prepared copolymer is melt-spun to fibers in the absence of solvent or plasticizing agent an acrylonitrile/methacrylonitrile copolymer. The copolymers produced by the process described herein contain a more random distribution of polymerized acrylonitrile and methacrylonitrile units and the copolymers are melt-processable even with high percentages of acrylonitrile. The melt processable polymer is formed by the polymerization of a mixture containing methacrylonitrile and acrylonitrile, wherein the addition of the monomers throughout the reaction is such that the ratio of unreacted acrylonitrile to methacrylonitrile remains essentially constant during the reaction. This results in a polymer composition wherein there are no long sequences of AN units or long sequences of MAN units, but a random ordering of these units in the polymer chain.

By practicing this process, melt-processable and stable polymers of 30 to 90 percent by weight acrylonitrile and up to 70 percent by weight methacrylonitrile can be formed. Preferably, the polymer is 50 to 85 percent by weight AN and up to 50 percent by weight MAN. Usually the polymer is no less than 40 weight percent AN nor more than 75 weight percent AN. The addition copolymers used to extrude the fibers used for the fabrics of this invention can contain copolymerized monomers other than AN and MAN. They have a combined weight percent of polymerized acrylonitrile and methacrylonitrile greater than 80 weight percent, preferably at least 85 weight percent, usually greater than 90 weight percent and often greater than 95 weight percent. Excluding the weight of additives and processing aids, copolymers of 100 percent by weight of polymerized acrylonitrile and methacrylonitrile can be used and no other monomer is needed for making the melt-processable and stable copolymers. Some other monomers that can be copolymerized with AN and MAN to make the starting material fibers are $C_1$ to $C_8$ alkyl acrylates, $C_1$ to $C_8$ alkyl methacrylates, vinyl acetate, a styrene of the formula

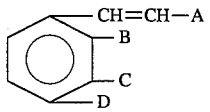

wherein each of A, B, C and D is independently selected from $C_1$ to $C_4$ alkyl groups and H; this includes styrene of course and all of the substituted or multiply-substituted styrenes embraced by said formula; vinyl acetate, vinyl chloride, vinyl bromide, vinyl fluoride, vinylidene chloride, vinylidene bromide and vinylidene fluoride.

As noted, melt-processable copolymers containing acrylonitrile and methacrylonitrile can be made by carefully controlling the ratio of unreacted acrylonitrile to the other unreacted monomers in the reaction mixture. After the desired initial ratio is established additional monomer is added in the same proportion as their incorporation into the polymer in order to maintain the initial ratio of unreacted AN to each of the other unreacted monomers essentially constant.

In a specific example, a melt-processable and stable polymer was made as follows:

In a 2-liter stirred glass reaction vessel were added 27.5 g of AN and 11.5 g of MAN. Then 1170 g of deionized water was added containing 11.7 g of GAFAC RE.-610 surfactant[1]. This was stirred until the surfactant dissolved. 2.6 g of dodecyl mercaptan was dissolved in a mixture of 27.5 g of AN and 11.5 g of MAN. The reaction vessel was previously flushed with $N_2$ gas and this was continued after the addition of the foregoing ingredients by bubbling the $N_2$ through the liquid contents. The reactor contents were heated to 60° C. Then 1.95 g of 2,2'-azobis-(2,4-dimethylvaleronitrile), the initiator, were added. The stirring was continued throughout the reaction.

[1]A mixture of $R—O—(CH_2CH_2O—)_nPO_3M_2$ and $[R—O—(CH_2CH_2O—)_n]_2PO_2M$ wherein n is a number of from 1 to 40, R is an alkylaryl or alkyl group and preferably a nonyl phenyl group and M is hydrogen, ammonia or an alkali metal, which composition is sold by the General Aniline and Film Corporation.

During the course of the ensuing 4.5 hours of polymerization AN and MAN were continuously introduced at rates to keep essentially constant the ratio of AN to MAN in the unreacted liquid. In each 90-minute period the rate of addition of AN was constant while the rate of addition of MAN constantly increased since MAN reacts faster than AN. Polymerization was carried out at 60° C. Over the first 90 minutes after the addition of the initiator there were added 82.3 g of AN and 42.8 g of MAN. Then 2.6 g of n-dodecyl mercaptan were added. Over the next 90 minutes 82.3 g of AN and 54.7 g of MAN were added, and over the final 90 minutes 82.3 g of AN and 66.8 g of MAN were added. The reactor contents were then rapidly chilled and then poured into a buchner funnel. During the pouring absorption of oxygen from the air effectively killed the initiator and all polymerization. Monomer conversion was 77.1 percent.

The filtering of the latex removed any lumps. The filtered latex was steam stripped with heating and a vacuum to remove most all residual monomers as their water azeotropes. The small remaining quantities of monomers were removed when the polymer crumb was later dried. The final product was 59.4 moles AN moiety for each 40.6 MAN moiety. It was designated A-12.

Similarly, another polymer was made containing 46.7 moles AN moiety for each 53.3 MAN moiety. It was designated A-13.

Monofilament fibers were spun using a spinneret having an orifice diameter of 42 mils (1066.8 μm).

The as-spun A-12 fibers had an average diameter of 236.1 μm, tensile strength of 17618 psi and an elongation at break of 121.25 percent (1-inch span). Its tenacity was 1.262 g/denier. Its denier was 429.

The as-spun A-13 fibers had an average diameter of 242.8 μm, tensile strength of 17904 psi and an elongation at break of 98.5 percent. Its tenacity was 1.161 g/denier. Its denier was 502.

Such monofilament fibers are formed into a non-woven fabric by any of the known methods for preparing non-woven fabrics.

For instance, thermoforming can be used. In a specific example fibers of A-12 discussed herein can be thermoformed. Thus, non-woven fabrics are easily thermoformed with application of light pressure at 140° C. for one minute.

The fabrics of the present invention, made of fibers containing 30–90 weight percent acrylonitrile moiety, besides being of low cost because of the method of preparation from the monomers, through the fibers and the non-woven fabrics, have numerous property advantages. Compared to the chief competitors in non-wovens, polypropylene and polyesters, the present fabrics have superior UV resistance, weatherability, water absorption, dyeability, is easily pigmented. In addition the fabrics have the superior chemical and solvent resistance of high nitrile polymers.

We claim:

1. A non-woven fabric produced from fibers formed in the absence of a solvent or a plasticizing agent from melt processable and stable copolymers containing 30 to 90 weight percent acrylonitrile moiety and up to 70 weight percent methacrylonitrile moiety and optionally less than 20 weight percent moieties of other comonomers wherein said copolymers are produced by an aqueous emulsion polymerization.

2. A non-woven fabric of claim 1 containing at least 85 weight percent acrylonitrile plus methacrylonitrile moieties.

3. A non-woven fabric of claim 1 containing greater than 90 weight percent acrylonitrile plus methacrylonitrile moieties.

4. A non-woven fabric of claim 1 containing greater than 95 weight percent acrylonitrile plus methacrylonitrile moieties.

5. A non-woven fabric of claim 1 containing polymerized moieties of only acrylonitrile and methacrylonitrile.

6. A non-woven fabric of claim 1 containing no more than 75 weight percent acrylonitrile moiety.

7. A non-woven fabric of claim 6 containing at least 85 weight percent acrylonitrile plus methacrylonitrile moieties.

8. A non-woven fabric of claim 6 containing greater than 90 weight percent acrylonitrile plus methacrylonitrile moieties.

9. A non-woven fabric of claim 6 containing greater than 95 weight percent acrylonitrile plus methacrylonitrile moieties.

10. A non-woven fabric of claim 6 containing polymerized moieties of only acrylonitrile and methacrylonitrile.

11. A non-woven fabric of claim 6 containing no less than 40 weight percent acrylonitrile moiety.

12. A non-woven fabric of claim 11 containing at least 85 weight percent acrylonitrile plus methacrylonitrile moieties.

13. A non-woven fabric of claim 11 containing greater than 90 weight percent acrylonitrile plus methacrylonitrile moieties.

14. A non-woven fabric of claim 11 containing greater than 95 weight percent acrylonitrile plus methacrylonitrile moieties.

15. A non-woven fabric of claim 11 containing polymerized moieties of only acrylonitrile and methacrylonitrile.

16. A non-woven fabric of claim 1 containing 50–85 weight percent acrylonitrile moiety and up to 50 weight percent methacrylonitrile moiety.

17. A non-woven fabric of claim 16 containing at least 85 weight percent acrylonitrile plus methacrylonitrile moieties.

18. A non-woven fabric of claim 16 containing greater than 90 weight percent acrylonitrile plus methacrylonitrile moieties.

19. A non-woven fabric of claim 16 containing greater than 95 weight percent acrylonitrile plus methacrylonitrile moieties.

20. A non-woven fabric of claim 16 containing polymerized moieties of only acrylonitrile and methacrylonitrile.

21. A non-woven fabric produced from fibers wherein said fibers are produced in the absence of solvent from a melt processable copolymer containing 30 to 90 weight percent acrylonitrile moiety and up to 70 weight percent methacrylonitrile moiety and optionally less than 20 weight percent moieties of other comonomers and wherein said melt processable copolymer is produced from an aqeous emulsion polymerization process comprising polymerizing a mixture of a methacrylonitrile monomer, acrylonitrile monomer and optionally other monomers wherein the addition of the monomer feed to the polymerization reaction is controlled throughout the polymerization so that the ratio of unreacted acrylonitrile monomer to unreacted methacrylonitrile monomer to unreacted other comonomers in the mixture is substantially constant during the polymerization reaction.

* * * * *